US008733132B2

(12) United States Patent
Motamedi

(10) Patent No.: US 8,733,132 B2
(45) **Date of Patent: *May 27, 2014**

(54) LAUNDRY TREATMENT APPLIANCE CONTROL SYSTEM

(75) Inventor: Nima Motamedi, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/612,974

(22) Filed: Sep. 13, 2012

(65) Prior Publication Data

US 2013/0008211 A1 Jan. 10, 2013

Related U.S. Application Data

(62) Division of application No. 12/640,465, filed on Dec. 17, 2009, now Pat. No. 8,296,889.

(51) Int. Cl.
*D06F 33/00* (2006.01)

(52) U.S. Cl.
USPC ..... 68/12.27

(58) Field of Classification Search
USPC ..... 8/158, 159; 68/12.27
See application file for complete search history.

(56) References Cited

FOREIGN PATENT DOCUMENTS

WO WO 2007011280 A1 * 1/2007

* cited by examiner

*Primary Examiner* — David Cormier

(57) ABSTRACT

A control system for a fabric treatment appliance configured to control the operation of the fabric treatment appliance as a function of a user-selected system input weighting.

21 Claims, 11 Drawing Sheets

LAUNDRY TREATMENT APPLIANCE CONTROL SYSTEM

CROSS-REFERENCE TO RELATED APPLICATIONS

The present application represents a divisional application of U.S. patent application Ser. No. 12/640,465 entitled "Laundry Treatment Appliance Control System" filed Dec. 17, 2009, which issued as U.S. Pat. No. 8,296,889 on Oct. 30, 2012.

BACKGROUND OF THE INVENTION

Laundry treating appliances, such as a washing machine or a clothes dryer, may implement a cycle of operation on a load of laundry placed inside a treatment chamber of the laundry treating appliance according to the settings of one or more operating parameters. The operating parameters may be set automatically by the laundry treating appliance based on input received from one or more sensors associated with the laundry treating appliance or based on input received from a user. In some instances, it may be difficult for a user to know what input to provide to the laundry treating appliance to achieve a desired outcome.

SUMMARY OF THE INVENTION

A control system for a laundry treatment appliance has a plurality of components that are operated to implement a treatment cycle having multiple operating parameters on a load of laundry received within a treating chamber of the appliance. The control system may comprise a selection landscape, a boundary adjuster and a controller operably coupled to the selection landscape and the boundary adjuster. The selection landscape may be subdivided into multiple selection zones, each selection zone representing a system input for the control system and having a boundary defining the area for the selection zone. The boundary adjuster may be operably coupled to the selection landscape to alter a boundary and thereby alter the corresponding area of at least one of the multiple selection zones. The controller may determine a system input weighting based on the area of at least one of the selection zones relative to the total area of all of the selection zones and determine at least one of the multiple operating parameters as a function of the determined system input weighting. The user may control the operation of the treatment cycle by moving the boundary adjuster relative to the landscape to change the system input weighting.

DESCRIPTION OF EMBODIMENTS OF THE INVENTION

Figure 1:
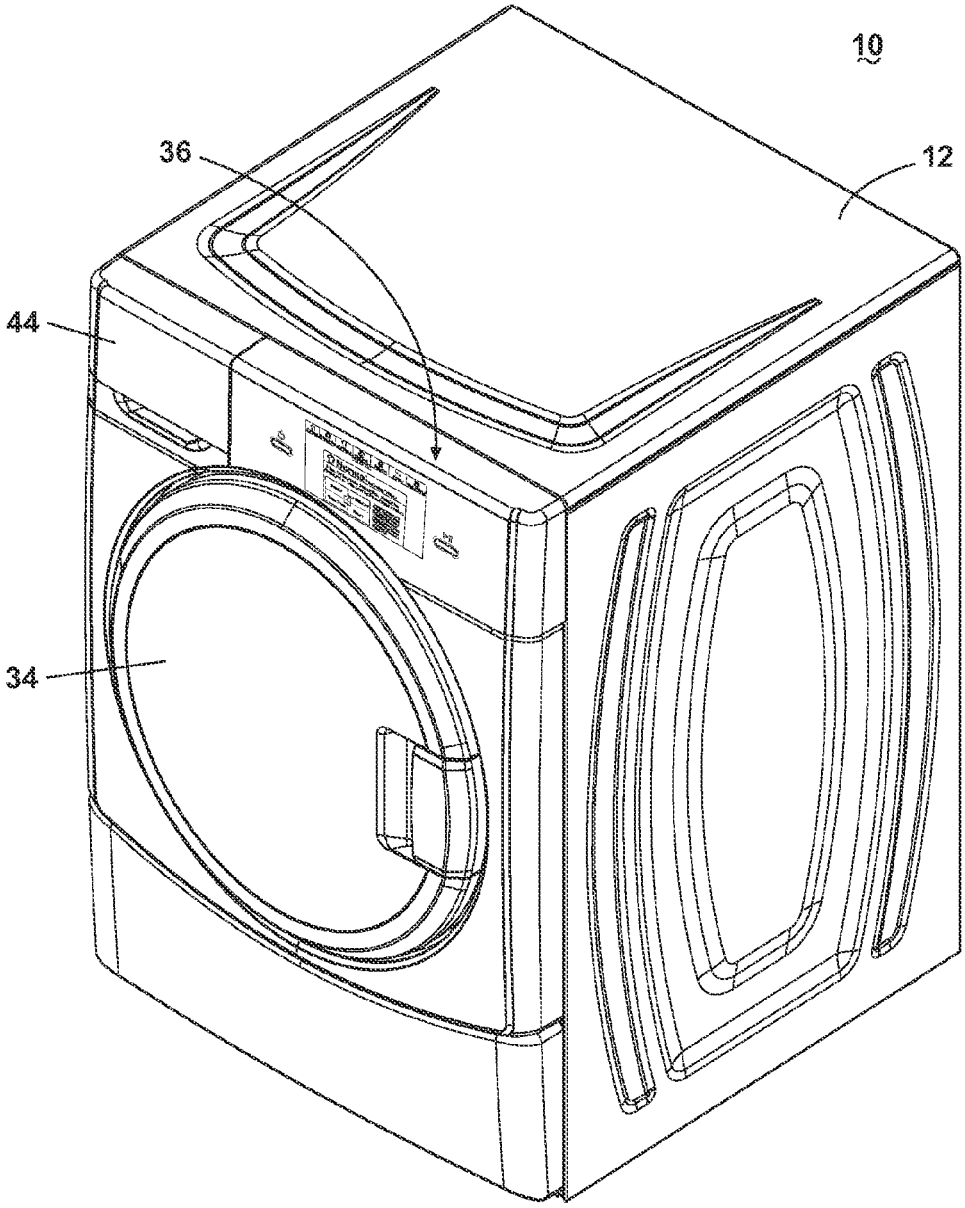
FIG. 1 is a perspective view of an exemplary fabric treating appliance in the form of a washing machine with an exemplary user interface according to a first embodiment of the invention.

FIG. 1 illustrates one embodiment of a laundry treating appliance according to the invention. The laundry treating appliance 10 according to the invention may be any appliance which performs a cycle of operation on laundry, non-limiting examples of which include a horizontal or vertical axis washing machine; a horizontal or vertical axis automatic dryer; a combination washing machine and dryer; a tumbling or stationary refreshing/revitalizing machine; an extractor; a non-aqueous washing apparatus; and a revitalizing machine. The laundry treating appliance 10 described herein shares many features of a traditional automatic washing machine, which will not be described in detail except as necessary for a complete understanding of the invention.

Figure 2:
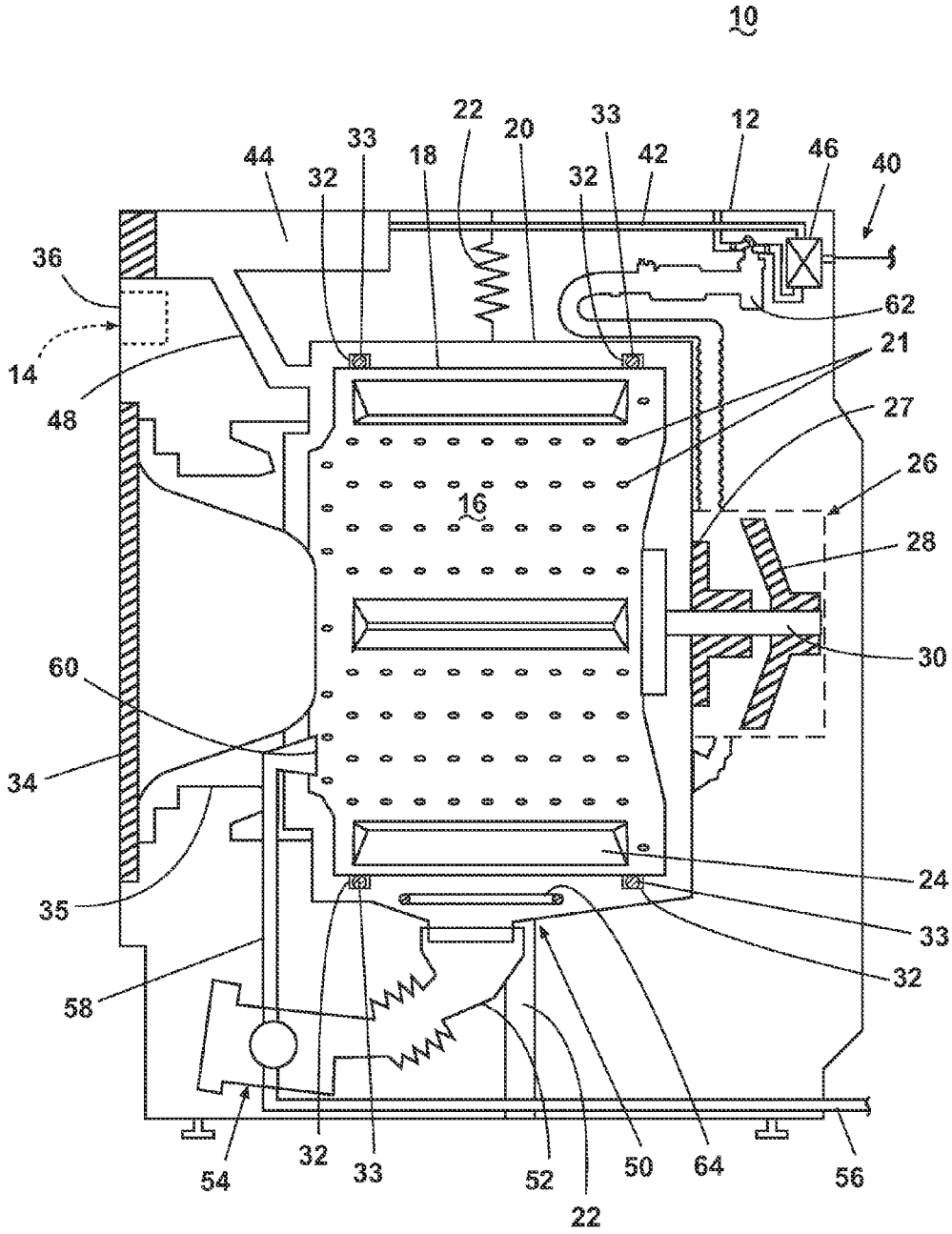
FIG. 2 is a schematic view of the fabric treating appliance of FIG. 1 according to the first embodiment of the invention.

FIG. 2 provides a schematic view of the washing machine 10 that may include a cabinet 12 having a controller 14 for controlling the operation of the washing machine 10 to complete a cycle of operation. A treating chamber 16 may be defined by a rotatable drum 18 located within the cabinet 12 for receiving laundry to be treated during a cycle of operation. The rotatable drum 118 may be mounted within a tub 20 and may include a plurality of perforations 21, such that liquid may flow between the tub 20 and the drum 18 through the perforations 21.

The drum 18 may further include a plurality of baffles 24 disposed on an inner surface of the drum 18 to lift the laundry load contained in the laundry treating chamber 16 while the drum 18 rotates. A motor 26 may be directly coupled with the drive shaft 30 to rotate the drum 18. The motor 26 may be a brushless permanent magnet (BPM) motor having a stator 27 and a rotor 28. Alternately, the motor 26 may be coupled to the drum 18 through a belt and a drive shaft to rotate the drum 18, as is known in the art. Other motors, such as an induction motor or a permanent split capacitor (PSC) motor, may also be used. The motor 26 may rotate the drum 18 at various speeds in either rotational direction.

Both the tub 20 and the drum 18 may be selectively closed by a door 34. A bellows 35 couples an open face of the tub 20 with the cabinet 12, and the door 34 seals against the bellows 35 when the door 34 closes the tub 20.

The cabinet 12 may also include a user interface 36 that may include one or more knobs, switches, displays, and the like for communicating with the user, such as to receive input and provide output. For example, the user interface 36 may include a power button 38 for activating the washing machine 10 and a start/pause button 39 for initiating or pausing an activity of the washing machine 10, such as a cycle of operation.

While the illustrated washing machine 10 includes both the tub 20 and the drum 18, with the drum 18 defining the laundry treating chamber 16, it is within the scope of the invention for the washing machine 10 to include only one receptacle, with the receptacle defining the laundry treating chamber for receiving the laundry load to be treated.

The washing machine 10 of FIG. 2 may further include a liquid supply and recirculation system. Liquid, such as water, may be supplied to the washing machine 10 from a water supply 40, such as a household water supply. A supply conduit 42 may fluidly couple the water supply 40 to the tub 20 and a treatment dispenser 44. The supply conduit 42 may be provided with an inlet valve 46 for controlling the flow of liquid from the water supply 40 through the supply conduit 42 to either the tub 20 or the treatment dispenser 44.

A liquid conduit 48 may fluidly couple the treatment dispenser 44 with the tub 20. The liquid conduit 48 may couple with the tub 20 at any suitable location on the tub 20 and is shown as being coupled to a front wall of the tub 20 in FIG. 2 for exemplary purposes. The liquid that flows from the treatment dispenser 44 through the liquid conduit 48 to the tub 20 typically enters a space between the tub 20 and the drum 18 and may flow by gravity to a sump 50 formed in part by a lower portion of the tub 20. The sump 50 may also be formed by a sump conduit 52 that may fluidly couple the lower portion of the tub 20 to a pump 54. The pump 54 may direct fluid to a drain conduit 56, which may drain the liquid from the washing machine 10, or to a recirculation conduit 58, which may terminate at a recirculation inlet 60. The recirculation inlet 60 may direct the liquid from the recirculation conduit 58 into the drum 18. The recirculation inlet 60 may introduce the liquid into the drum 18 in any suitable manner, such as by spraying, dripping, or providing a steady flow of the liquid.

The liquid supply and recirculation system may further include one or more devices for heating the liquid such as a steam generator 62 and/or a sump heater 64.

The steam generator 62 may be provided to supply steam to the treating chamber 16, either directly into the drum 18 or indirectly through the tub 20 as illustrated. The valve 46 may also be used to control the supply of water to the steam generator 62. The steam generator 62 is illustrated as a flow through steam generator, but may be other types, including a tank type steam generator. Alternatively, the heating element 64 may be used to generate steam in place of or in addition to the steam generator 62. The steam generator 62 may be controlled by the controller 14 and may be used to heat to the laundry as part of a cycle of operation, much in the same manner as heating element 64. The steam generator 62 may also be used to introduce steam to treat the laundry as compared to merely heating the laundry.

Additionally, the liquid supply and recirculation system may differ from the configuration shown in FIG. 2, such as by inclusion of other valves, conduits, wash aid dispensers, sensors, such as water level sensors and temperature sensors, and the like, to control the flow of liquid through the washing machine 110 and for the introduction of more than one type of detergent/wash aid. Further, the liquid supply and recirculation system need not include the recirculation portion of the system or may include other types of recirculation systems.

Figure 3:
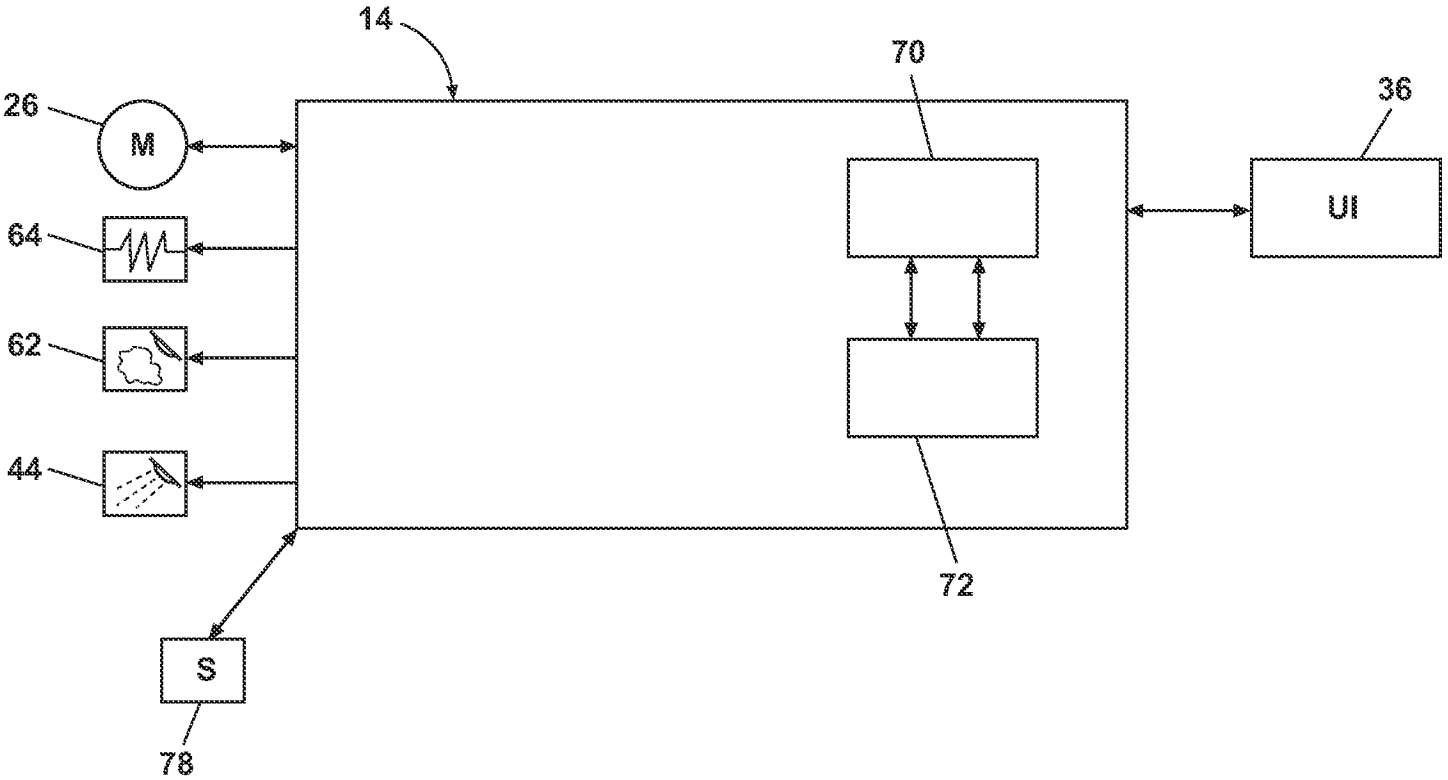
FIG. 3 is a schematic view of an exemplary control system of the fabric treating appliance of FIG. 1 according to the first embodiment of the invention.

As illustrated in FIG. 3, the controller 14 may be provided with a memory 70 and a central processing unit (CPU) 72. The memory 70 may be used for storing the control software that is executed by the CPU 72 in completing a cycle of operation using the washing machine 10 and any additional software. For example, the memory 70 may store one or more pre-programmed cycles of operation that may be selected by a user and completed by the washing machine 10. The memory 70 may also be used to store information, such as a database or table, and to store data received from one or more components of the washing machine 10 that may be communicably coupled with the controller 14.

The controller 14 may also receive input from one or more sensors 78, which are known in the art and not shown for simplicity. Non-limiting examples of sensors 78 that may by communicably coupled with the controller 114 include: a treating chamber temperature sensor, a moisture sensor, a weight sensor, a position sensor and a motor torque sensor.

The controller 14 may be operably coupled with one or more components of the washing machine 10 for communicating with and controlling the operation of the component to complete a cycle of operation. For example, the controller 14 may be coupled with the motor 26 for controlling the direction and speed of rotation of the drum 18 and the treatment dispenser 44 for dispensing a treatment during a cycle of operation. The controller 14 may also be coupled with the user interface 36 for receiving user selected inputs and communicating information to the user.

The controller 14 may control the components of the washing machine 10 to complete one of the pre-programmed cycles of operation stored in the controller memory 70 based on a setting of one or more operating parameters. The pre-programmed cycles of operation may correspond to a type of fabric, color, a soil level or an amount or size of one or more laundry items in the load, for example. The operating parameters may be set to control the components of the washing machine 10 to provide the recommended fabric care for the selected cycle of operation. At least some of the operating parameters may be considered quantitative in the sense that a measurable input value to control the operation of the component results in a measurable output.

The operating parameters may be set automatically by the controller 14 when the user selects one of the pre-programmed cycles of operation stored in the controller memory 70. Alternatively, one or more of the operating parameters may be set by the user to modify one of the pre-programmed cycles of operation according to the user's preferences. For example, the user may select a cycle of operation and then manually adjust the wash temperature to a desired wash temperature different than the default temperature for the selected cycle. In another example, one or more operating parameters may be set automatically based on one or more characteristics of the laundry load input manually by the user through the interface 36 or automatically determined by the controller 14 based on input received from one or more sensors. For example, the controller 14 may automatically adjust the amount of water used during a rinse phase based on the amount of laundry, determined either based on user input or automatically by a load sensor.

Non-limiting examples of quantitative operating parameters include temperature, drum speed, amount of water used, duration of a cycle or phase of a cycle, an amount and/or concentration of a treatment to dispense, a time to dispense a treatment, a duration of a soak or pre-soak phase, a temperature of a soak or pre-soak, a tumble speed and duration, a spin speed and duration, an imbalance limit, a cycle or cycle phase delay and a number of times a phase in the cycle is repeated (e.g. the number of rinses). Non-limiting examples of a treatment that may be dispensed include steam, water, a detergent, an oxygen-based bleach, a chlorine-based bleach, a stain treatment or prevention chemistry, a fragrance, an anti-wrinkle agent and an anti-static agent. Non-limiting examples of qualitative operating parameters include the on/off or yes/no selection of a parameter, non-limiting examples of which include to use steam, dispense a treatment, perform an extra rinse and perform a soak or pre-soak phase.

The user interface 36 may also include a touch-sensitive display or touch screen 100 for receiving input from a user and displaying output to the user. The controller 14 may receive input from the user through the touch screen 100 and display visual output to the user in the form of graphics, texts, icons, video and any combination thereof. The touch screen 100 may receive input from the user based on tactile contact, such as by a user touching the touch screen 100 with an object, such as a finger. The controller 14 may detect contact, including movement of the contact, on the touch screen 14 and convert the detected contact into interaction with the objects (graphics, texts, icons, etc . . . ) displayed on the touch screen 100. The controller 14 may be programmed to detect contact and movement of a contact according to any known methodology.

The touch screen 100 may be any suitable type of touch screen display, such as a liquid crystal display (LCD) or light emitting polymer display (LPD). Non-limiting examples of suitable touch sensing technologies that may be used with the touch screen 100 include capacitive, resistive, infrared, pressure and surface acoustic waves.

The controller 14 may be provided with software in the controller memory 70 which may be executed by the CPU 72 to sequentially display on the touch screen 100 and navigate through a variety of input/output screens based on the user input received from the touch screen display 100. Each input/output screen may provide the user with the opportunity to input information to control the operation of the washing machine 10 and may provide output to communicate information with the user.

For example, upon turning on of the washing machine 10, an input/output screen may be presented to the user, prompting the user to select a desired cycle of operation from a plurality of available user-selectable cycles. Based on the cycle selected by the user, additional input/output screens may be displayed in which the user may modify the selected cycle by adjusting one or more operating parameters or by providing input upon which the controller 14 may automatically modify the selected cycle of operation. Each subsequent input/output screen displayed to the user on the touch screen 100 may be based on user input from the previously displayed input/output screen.

As discussed above, the controller 14 may be pre-programmed with any number of user-selectable operating cycles that a user may select to complete a cycle of operation on a load of laundry. However, the user may desire to modify or tailor these pre-programmed cycles according to the user's preferences and/or characteristics of the load to achieve a specific goal or outcome. In some cases, a user may intuitively know how to adjust an operating parameter of a cycle to achieve a desired outcome, such as when the desired outcome is quantitative and is directly linked to a quantitative operating parameter. For example, if the user desires to wash the laundry at a higher temperature, the user may manually adjust the temperature of the wash to a higher temperature. In this manner, the desired outcome is directly related to the operating parameter responsible for controlling the outcome.

In some cases, however, the user may not know how to modify the operating parameters of an operating cycle to achieve a desired goal. For example, if the user's goal is related to the overall performance of the cycle and/or machine, the user may not know how and/or may not be able to adjust multiple operating parameters to achieve the performance goal. Non-limiting examples of performance goals include conducting an operating cycle that is cleaner, quicker, gentler, more environmentally friendly (e.g. less energy and/or less water), more energy efficient and dryer, in the case of a drying machine.

The performance goals may be considered qualitative goals in that they are not necessarily directly effected by the modification of any one operating parameter. For example, the user may select a cycle of operation, such as a normal wash cycle, and then desire to modify the cycle so that the cycle is more gentle. The user may not know how, or may not be provided with the opportunity, to modify the necessary operating parameters to conduct the selected cycle to achieve the performance goal of a gentler normal wash cycle. In addition, the user may desire to modify a cycle to achieve varying levels of a performance goal. For example, the user may desire to modify the level or extent of gentleness for a selected cycle.

In addition, the modification of one or more operating parameters to achieve one performance goal may negatively impact other performance goals. For example, modifications of one or more operating parameters to achieve the user-selected performance goal of a cleaner operating cycle may result in longer cycle times, negatively impacting the performance goal of a quicker operating cycle. The impact of achieving one performance goal on the outcome of other performance goals is not necessarily intuitively apparent to the user. Therefore, it may be useful to communicate to the user the impact of modifying an operating cycle to achieve one performance goal on the ability of the operating cycle to achieve other performance goals.

Figure 4:
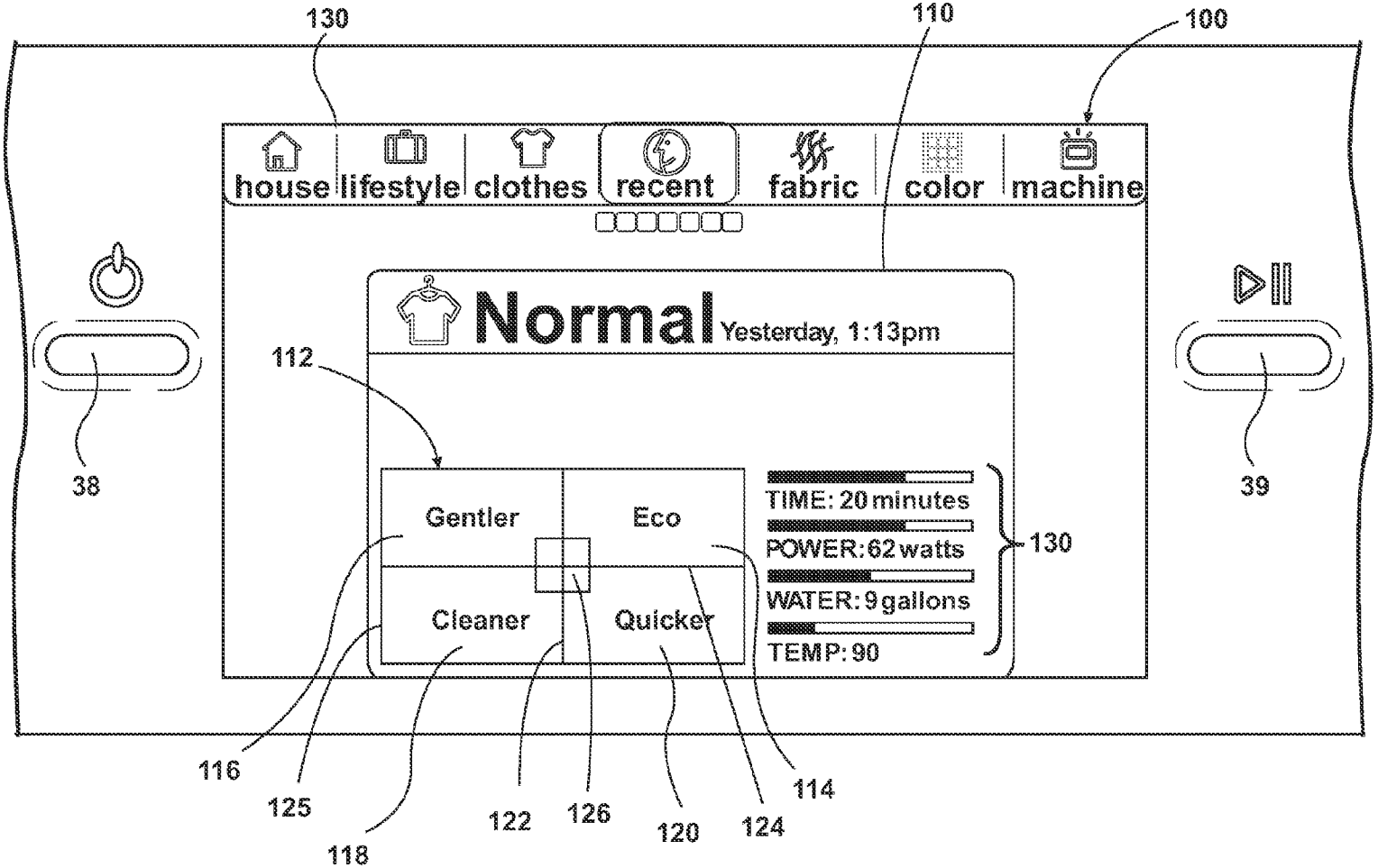
FIG. 4 is a front view of a user interface displaying a selection input/output screen according to a second embodiment of the invention.

Referring now to FIG. 4, the touch screen 100 may be used by the user to select a weighting of one or more system inputs and the controller 14 may modify the operation of the washing machine 10 according to the weighting selected by the user. The controller may be pre-programmed to modify the operation of the washing machine 10 as a function of the weighting given to the one or more system inputs by the user based on empirical data or according to one or more functions.

The system input may be a qualitative parameter, non-limiting examples of which include a performance goal for an operating cycle and a characteristic of the laundry load, such as an amount of laundry, a color of the laundry and a type of fabric, for example. The system input may also be a quantitative operating parameter, non-limiting examples of which include temperature, drum speed, amount of water used, duration of a cycle or phase of a cycle, an amount and/or concentration of a treatment to dispense, a time to dispense a treatment, a duration of a soak or pre-soak phase, a temperature of a soak or pre-soak, a tumble speed and duration, a spin speed and duration, an imbalance limit, a cycle or cycle phase delay and a number of times a phase in the cycle is repeated (e.g. the number of rinses). The system input may also be a qualitative operating parameter, non-limiting examples of which include the on/off or yes/no selection of a parameter, non-limiting examples of which include to use steam, dispense a treatment, perform an extra rinse and perform a soak or pre-soak phase. While the invention will be described in the context of selecting a weighting for a performance goal for a cycle of operation, it will be understood that the invention may used with any system input, as described above.

Still referring to FIG. 4, the user may select a performance goal through the touch screen 100 and the controller 14 may adjust the operating parameters of a cycle of operation to achieve the selected performance goal. The selection of the performance goal may be a function of the weighting or priority the user gives to one or more of the available performance goals displayed on the touch screen 100.

The touch screen 100 may display a selection input/output screen 110 through which the user may select a desired performance goal by weighting the priority of each performance goal relative to the other performance goals. The selection screen 110 may include a selection landscape 112 that may be subdivided into multiple areas, each area corresponding to a system input. The selection landscape 112 may be sub-divided into four selection zones 114, 116, 118 and 120 corresponding to four user-selectable performance goals "Quicker", "Cleaner", "Gentler" and "Eco" (environmentally friendly), respectively.

The selection landscape 112 may be sub-divided into the four selection zones by the intersection of a vertical boundary line 122 and a horizontal boundary line 124 extending between parallel segments of a selection landscape border 125. As illustrated in FIG. 4, the selection landscape border 125 defines a square corresponding to the area of the selection landscape 112. It is also within the scope of the invention for the selection landscape border 125 to define a rectangle or any other polygonal shape. It is also within the scope of the invention for the selection landscape 112 to be sub-divided into any number of selection zones corresponding to any number of user-selectable performance goal outcomes.

It is within the scope of the invention for the touch screen 100 to have any shape and display additional output in addition to the selection screen 110 that may or may not be related to the selection screen 110, such as icons or text to navigate away from the selection screen, to start a cycle of operation, to adjust other parameters of the operating cycle, to select an operating cycle, status indicators and a help button.

The selection screen 110 may also include a boundary adjuster 126 which may be selectively moved by the user over the performance goal landscape 112 to select a performance goal weighting. The boundary adjuster 126 may be associated with the vertical boundary line 122 and the horizontal boundary line 124 such that movement of the boundary adjuster 126 results in a corresponding movement of the vertical boundary line 122 and/or the horizontal boundary line 124. The boundary adjuster 126 may be in the form of any regular or irregular polygon. For example, the boundary adjuster 126 may be an indicator, such as an icon, having any suitable shape, such as a square, which is illustrated in FIG. 4, or in the form of a circle.

It is also within the scope of the invention for the intersection of the vertical and horizontal boundary lines 122, 124 to form the boundary adjuster 126, such that the intersection is not highlighted by an indicator. It is also within the scope of the invention for the intersection of the vertical and horizontal boundary lines 122, 124 to be highlighted in any suitable manner, such as by displaying the intersection in a different color, a higher intensity and/or a flashing indicator to indicate to the user where to contact the screen to adjust the selection zones 114, 116, 118 and 120. Alternatively, the intersection may not be highlighted at all.

The operating parameters of a user-selected cycle of operation may be adjusted as a function of the weighting of each selection zones 114, 116, 118 and 120 according to the location of the boundary adjuster 126 and the vertical and horizontal boundary lines 122, 124 relative to the selection landscape 112. As illustrated in FIG. 4, the boundary adjuster 126 is located at the center of the selection landscape 112 such that the vertical boundary line 122 and horizontal boundary line 124 divide the performance goal landscape 112 into equal sized selection zones. The user may alter the balance between the performance goals and give more weight to one or more performance goals relative to the other performance goals using the boundary adjuster 126 to move the vertical boundary line 122 and/or horizontal boundary line 124.

When the boundary adjuster 126 is centered about the intersection of the four selection zones 114, 116, 118 and 120, the operating parameter settings for the cycle of operation may correspond to the default settings for the selected cycle prior to adjusting the cycle to achieve a desired performance goal. The operating parameters may be set so as to complete the cycle of operation according to the predetermined settings for the selected cycle of operation stored in the controller memory 70. The operating parameters for the pre-programmed cycles of operation may be set to provide the recommended treatment for the laundry according to the selected cycle. Depending on the operating cycle, the default settings for the operating parameters may already be set such that one or more performance goals is weighted more than the other.

For example, the predetermined settings for a "delicates" wash cycle typically combine a low-speed tumbling and a medium-speed spinning for a "gentler" wash cycle than a "normal/casual" wash cycle. However these settings may not necessarily result in a cycle that is quick. The user may alter the default weighting between the performance goals and give more weight to one or more performance goals relative to the other performance goals by moving the boundary adjuster 126 to adjust the area of the selection zones 114, 116, 118 and 120. For example, in the case of a "delicates" wash cycle, in which the predetermined operating parameters are set to achieve a gentle wash cycle, the user may desire to modify the "delicates" wash cycle so that it is quicker.

When the boundary adjuster 126 is positioned at the center of the selection landscape 112 such that the four selection zones 114, 116, 118 and 120 are of equal area, the operating parameters may be set to the default settings for the selected cycle of operation, which may or may not balance the four performance goals, depending on the selected cycle. The user may alter the default weighting of the performance goals for the selected cycle by moving the boundary adjuster 126 to adjust the location of the vertical boundary line 122 and/or horizontal boundary line 124 such that the selection zones 114, 116, 118 and 120 are not of equal size to give more weight to one or more performance goals compared to the others.

Alternatively, when the boundary adjuster 126 is positioned at the center of the selection landscape 112 such that the four selection zones 114, 116, 118 and 120 are of equal area, the operating parameter settings for the cycle of operation may correspond to settings for the selected cycle that balance the four performance goals. The user may then use the boundary adjuster 126 to select a weighting of the performance goals and the settings for the operating parameters may be adjusted from the initial settings in which the performance goals are balanced to settings corresponding to the weighting of the performance goals selected by the user.

When a user selects a cycle of operation and then navigates to the selection screen 110, the boundary adjuster 126 may initially be positioned at the center of the selection landscape 112 such that the four selection zones 114, 116, 118 and 120 are of equal area, such that the performance goals are balanced. Alternatively, the boundary adjuster 126 may initially be positioned such that it corresponds to the weighting of the performance goals based on the default operating parameters for the selected cycle of operation. A user may then move the boundary adjuster 126 to the center of the selection landscape 112 such that the areas of the four selection zones 114, 116, 118 and 120 are equal to balance the four performance goals, if desired.

The user may move the boundary adjuster 126 relative to the selection landscape 112 by contacting the touch screen 100 at an area corresponding to or adjacent to the boundary adjuster 126 and moving the contact relative to the selection landscape 112 to a desired location. For example, the user may contact the touch screen 100 using a finger at an area of the touch screen 100 corresponding to the display of the boundary adjuster 126. The controller 14 may be programmed to detect a contact event within or adjacent to the boundary adjuster 126. Once the contact event has been detected, movement of the contact results in a corresponding movement of the boundary adjuster 126, as is known in the art. In this manner, the user may move the boundary adjuster 126 to a desired location relative to the selection landscape 112. The controller 14 may also be programmed to move the vertical boundary line 122 and horizontal boundary line 124 relative to the selection landscape 112 based on the movement of the boundary adjuster 126.

While the invention is described in the context of a touch screen 100 through which the user may directly interact with the selection screen 110, it is also within the scope of the invention for the user to interact with the selection screen 110 indirectly using any other suitable type of input mechanism, non-limiting examples of which include a mouse, a track ball, a joystick, a dial and one or more buttons or keys.

Figure 5:
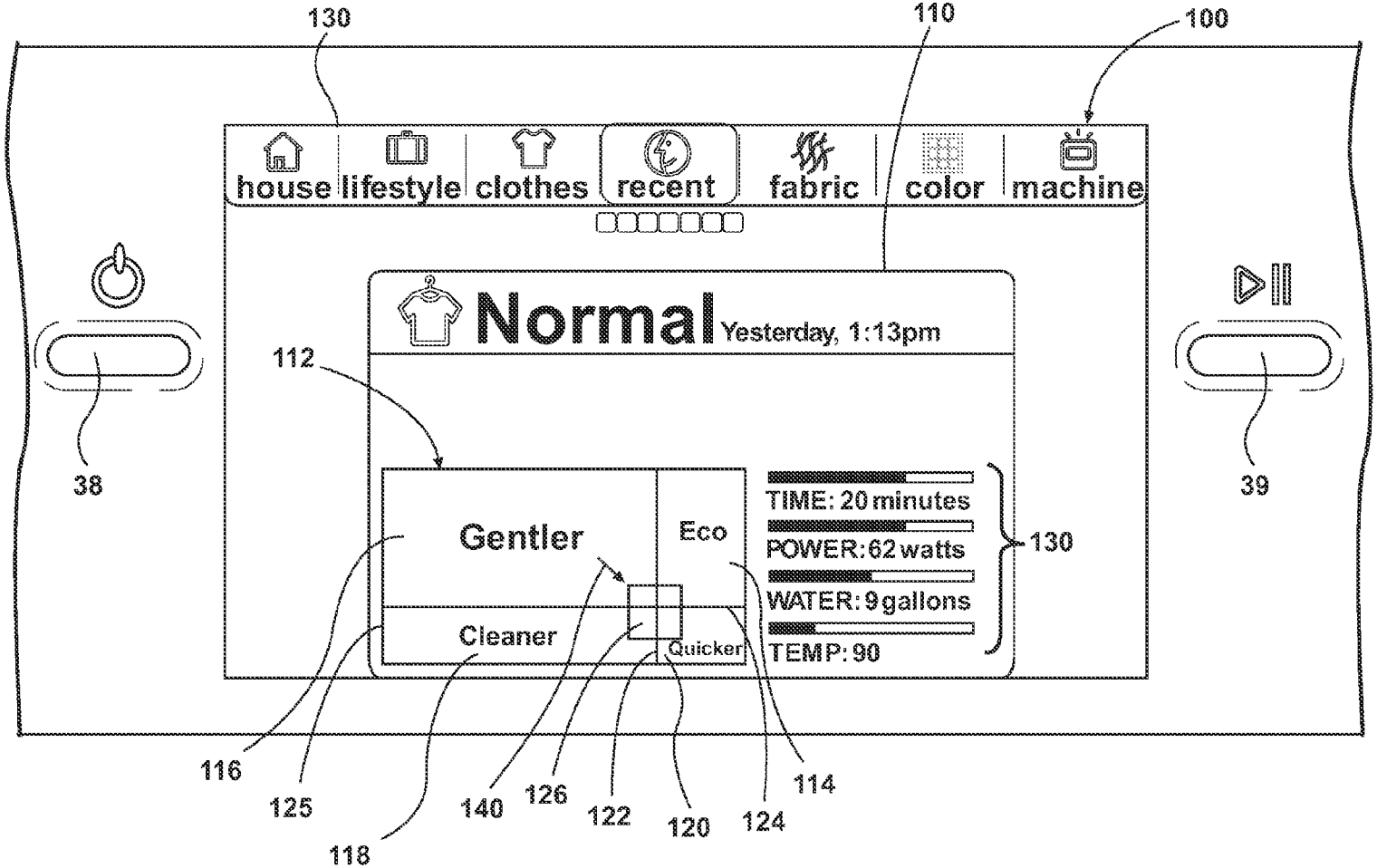
FIG. 5 is a front view of a user interface displaying a selection input/output screen according to the second embodiment of the invention.

As illustrated in FIG. 5, the boundary adjuster 126 may be moved, as illustrated by arrow 140 from the centrally located position in FIG. 4 to that illustrated in FIG. 5 to select a performance goal in which the user weights a single performance goal as a higher priority and gives less weight to the other performance goals. For example, as illustrated in FIG. 5, the user may weight the performance goal "Gentler" as the highest priority by moving the boundary adjuster 126 and dragging the vertical and horizontal boundary lines 122, 124 relative to the selection landscape 112 such that the selection zone 116 corresponding to the performance goal "Gentler" has the largest area relative to the other three performance goals. In this manner the user may give more weight to the performance goal "Gentler" than the other three performance goals. The controller 14 may adjust one or more operating parameters of the selected cycle as a function of the weighting selected by the user to achieve the performance goal indicated by the user.

It is also within the scope of the invention for the user to adjust the areas of the selection zones 114, 116, 118 and 120 such that all of the weight is given to a single performance goal and no weight is given to the other three performance goals. For example, referring now to FIG. 6, the user may continue to drag the boundary adjuster 126 in the direction indicated by the arrow 140 in FIG. 5 such that the selection zone 116 corresponding to the performance goal "Gentler" encompasses the entire area of the selection landscape 112. As the area of the selection zone 116 increases, the text indicating the performance goal may also increase in size, although it is within the scope of the invention for the text size to not increase.

Figure 7:
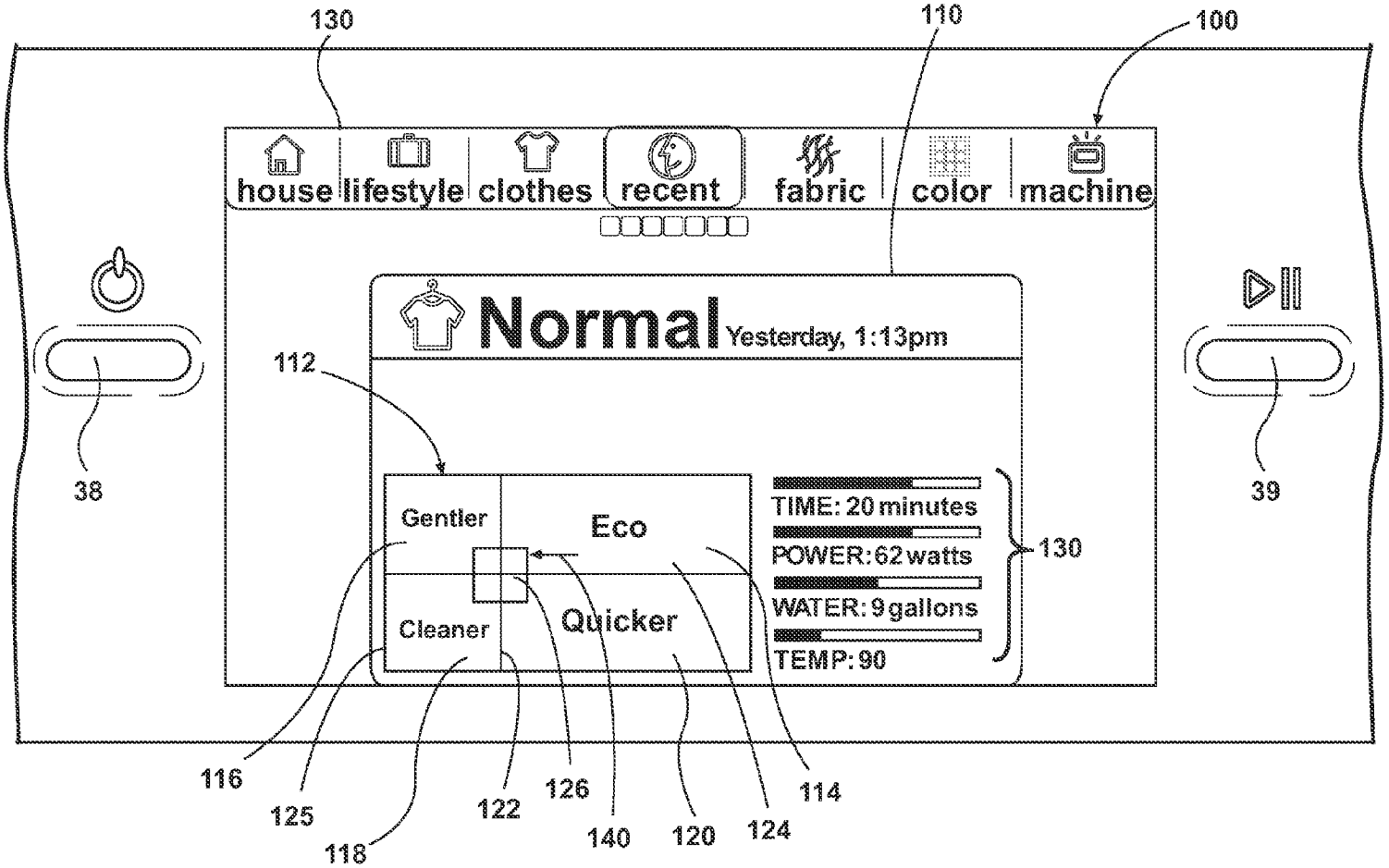
FIG. 7 is a front view of a user interface displaying a performance goal selection screen according to the second embodiment of the invention.

Referring now to FIG. 7, the user may use the boundary adjuster 126 to select two performance goals by moving the boundary adjuster 126 such that the area corresponding to the performance goals the user desires to give more weight to becomes larger while the areas corresponding to the performance goals of less importance to the user become smaller. As illustrated in FIG. 7, the user may move the boundary adjuster 126 to modify the selected cycle such that more weight is given to achieving the goals of "Quicker" and "Eco" than the goals of "Gentler" and "Cleaner." The user may continue to drag the boundary selection 126 in the direction indicated by arrow 140 all the way to the edge of the selection landscape 112 such that the area of the selection landscape 112 is divided between the selection zones 114 and 120 and the selection zones 116 and 118 have no area. In this manner, the user may select to give weight to only two performance goals, "Eco" and "Quicker" and no weight to the performance goals "Gentler" and "Cleaner."

Figure 8:
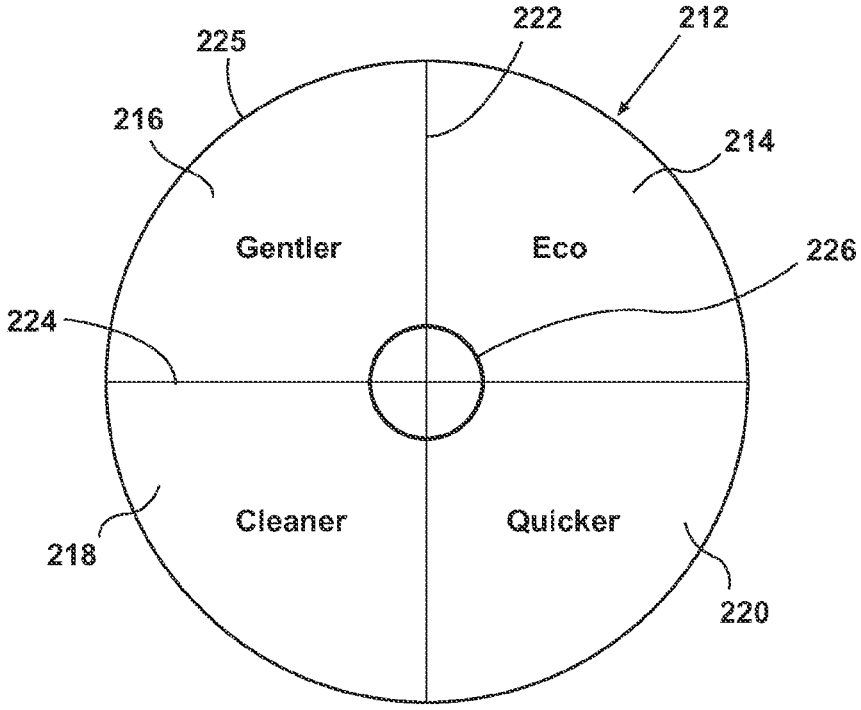
FIG. 8 is a front view of a user interface displaying a selection input/output screen according to a third embodiment of the invention.

FIG. 8 illustrates a second embodiment of the invention comprising a selection landscape 212, which is similar to the first selection landscape 112, except for the shape of the selection landscape 212. Therefore, elements in the selection landscape 212 similar to those of selection landscape 112 will be numbered with the prefix 200. The selection landscape 212 may be used with the selection screen 110 in the same manner as the selection landscape 112.

The selection landscape 212 may be defined by a selection landscape border 225 in the form of a circle. The selection landscape 212 may be sub-divided into four selection zones 214, 216, 218 and 220 by the intersection of a vertical boundary line 122 and a horizontal boundary line 124 extending from a first side of the selection landscape border 125 a second side opposite the first. Each selection zone 214, 216, 218 and 220 may correspond to a performance goal in a manner similar to that described above for the selection landscape 112.

The selection landscape 212 may also include a boundary adjuster 226 which may be selectively moved by the user relative to the selection landscape 212 to select a performance goal. The boundary adjuster 226 may be associated with vertical boundary line 222 and the horizontal boundary line 224 such that movement of the boundary adjuster 226 results in a corresponding movement of the vertical boundary line 222 and/or the horizontal boundary line 224. As illustrated in FIG. 8, when the boundary adjuster 226 is located at a position corresponding to the center of the selection landscape 212, the selection zones 214, 216, 218 and 220 are divided into four pie-shaped zones having the same area.

Figure 9:
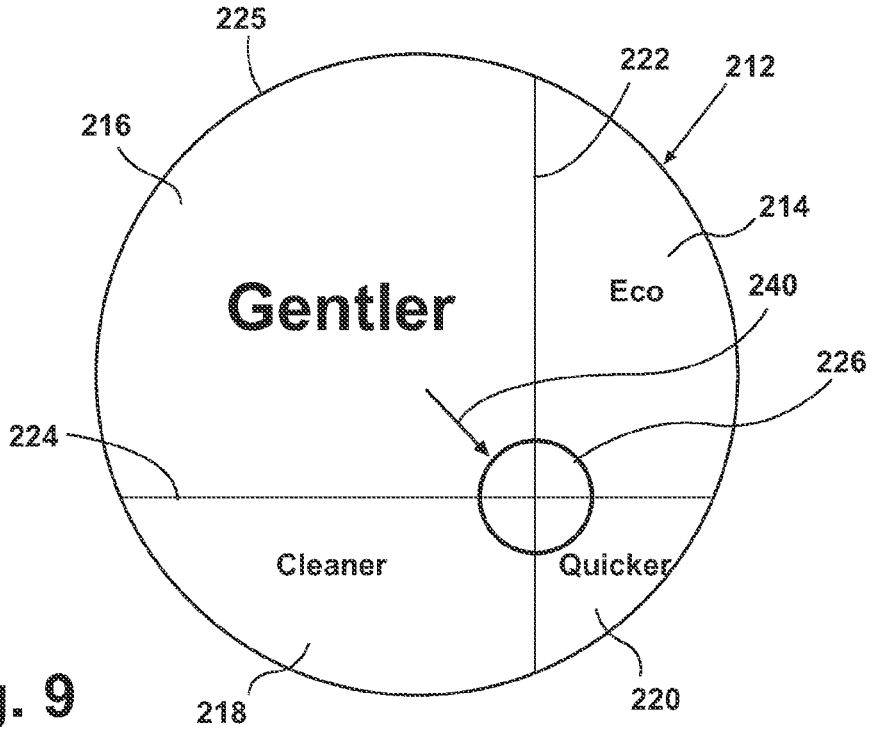
FIG. 9 is a front view of a user interface displaying a selection input/output screen according to the third embodiment of the invention.

Referring now to FIG. 9, the user may move the boundary adjuster 226 as indicated by arrow 240 to drag the vertical boundary line 222 and/or the horizontal boundary line 224 such that the area of one or more of the selection zones 214, 216, 218 and 220 changes. The user may move the boundary adjuster 226 to change the area of the selection zones 214, 216, 218 and 220 to select a desired performance goal weighting in the same manner as discussed above with respect to the selection landscape 112.

Figure 10:
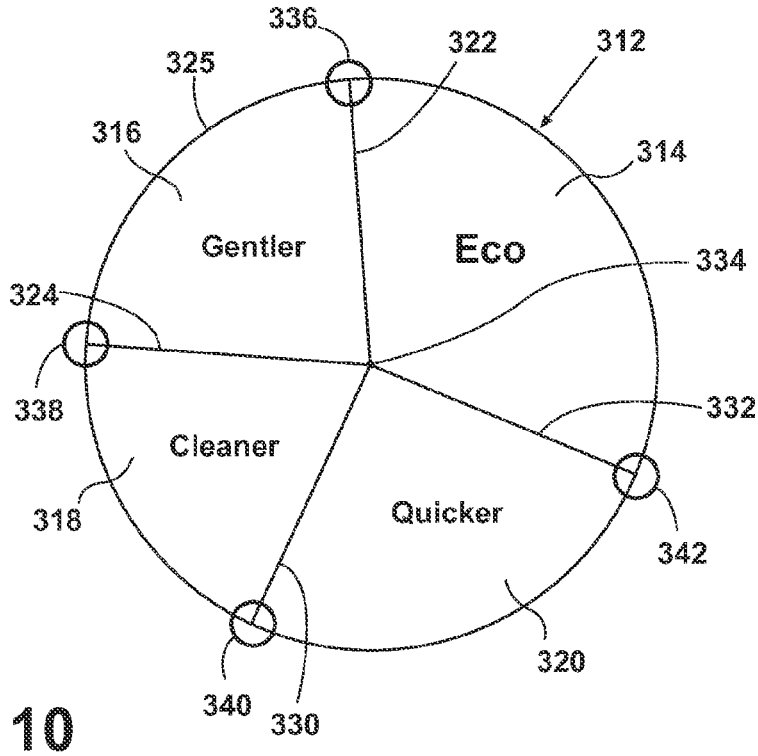
FIG. 10 is a front view of a user interface displaying a selection input/output screen according to a fourth embodiment of the invention.

FIG. 10 illustrates a third embodiment of the invention comprising a selection landscape 312, which is similar to the first selection landscape 212, except for the manner in which the area of a selection zone 314, 316, 318 and 320 is changed. Therefore, elements in the selection landscape 312 similar to those of selection landscape 212 will be numbered with the prefix 300. The selection landscape 312 may be used with the selection screen 110 in the same manner as the selection landscape 212.

The selection landscape 312 may be divided into multiple selection zones by multiple boundary lines 322, 324, 330 and 332 extending from a center 334 of the selection landscape 312 to multiple intersections 336, 338, 340 and 342, respectively, with a selection landscape border 325. As illustrated in FIG. 10, each of the boundary lines 322, 324, 330 and 332 may extend from the center 334 such that the selection landscape 312 is divided into four selection zones 314, 316, 318 and 320 corresponding to the four performance goals, "Eco", "Gentler", "Cleaner" and "Quicker."

Figure 11:
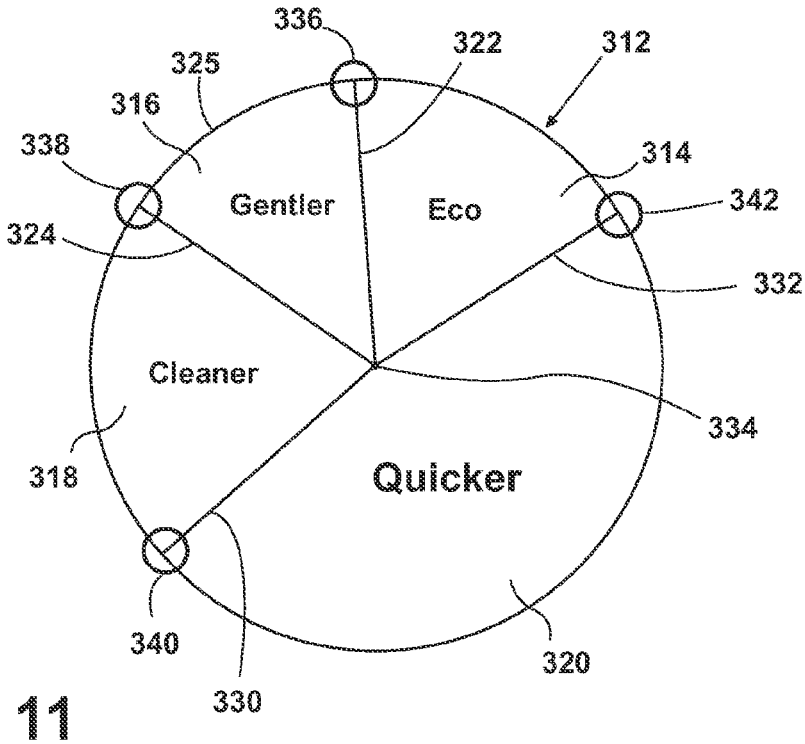
FIG. 11 is a front view of a user interface displaying a selection input/output screen according to the fourth embodiment of the invention.

The user may adjust the size of the selection zones 314, 316, 318 and 320 by moving the corresponding intersections 336, 338, 340 and 342 along the selection landscape border 325, as illustrated in FIG. 11, which causes the boundary lines 322, 324, 330 and 332 to rotate about the center 334. The user may move one or more of the intersections 336, 338, 340 and 342 to change the area of the selection zones 314, 316, 318 and 320 to select a desired performance goal weighting in the same manner as discussed above with respect to the selection landscape 112.

While the selection landscape 312 is illustrated as being divided into four selection zones 314, 316, 318 and 320 by four boundary lines 322, 324, 330 and 332, respectively, it is within the scope of the invention for the selection landscape 312 to be divided into any number of selection zones by any number of boundary lines. In addition, while the intersection of each of the boundary lines 322, 324, 330 and 332 with the landscape border 325 is illustrated as being highlighted by an encompassing circle for the purposes of illustration, they are not necessarily displayed on the touch screen 100 during operation. It is also within the scope of the invention for any suitable icon and or indicator to be displayed on the touch screen 100 to indicate to a user that the intersections 336, 338, 340 and 342 are moveable.

It is also within the scope of the invention for the center 334 to be moveable such that a user may drag the center 334 over the selection landscape 312 to adjust the weightings in a manner similar to that described with respect to the selection landscape 212 illustrated in FIGS. 8-9. The boundary lines 322, 324, 330 and 332 may be coupled with the center 334 such the user may drag the center 334 over the selection landscape 312 to modify the length of the boundary lines 322, 324, 330 and 332 and thus the area of each of the selection zones 314, 316, 318 and 320. The center 334 may be highlighted using any suitable type of icon or indicator to indicate to the user that the center 334 is moveable. The moveable center 334 may be used alone or in combination with the moveable intersections 336, 338, 340 and 342 to modify the area of each selection zone 314, 316, 318 and 320.

Figure 12:
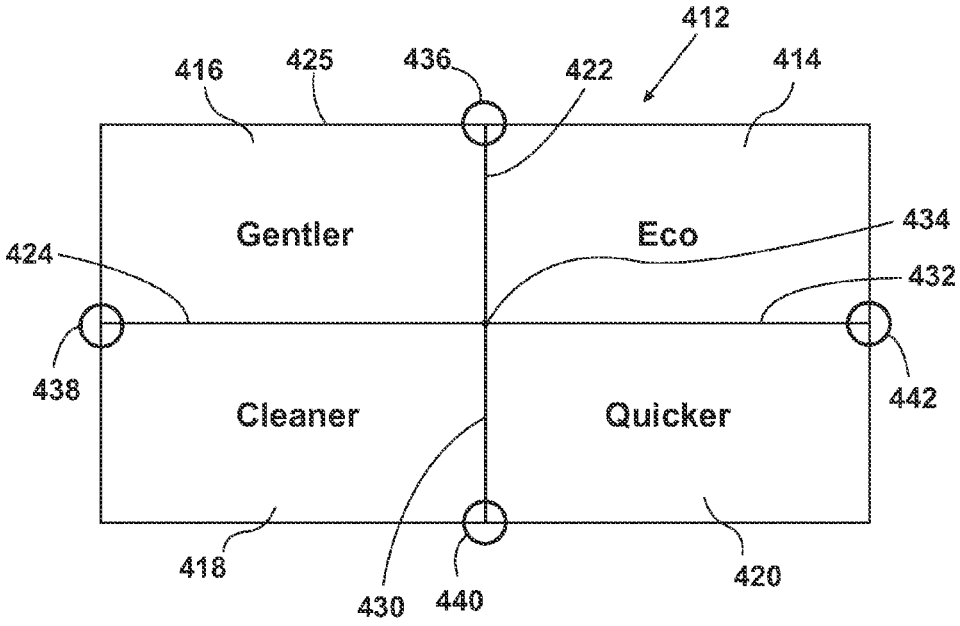
FIG. 12 is a front view of a user interface displaying a selection input/output screen according to a fifth embodiment of the invention.

While the embodiment of the selection landscape 312 illustrated in FIGS. 10 and 11 is illustrated as having a circular landscape border 325, it is within the scope of the invention for the landscape border 325 to form any regular or irregular polygon. For example, FIG. 12 illustrates a selection landscape 412 that is similar to the selection landscape 312 except for the shape of the landscape border 425. Therefore, elements in the selection landscape 412 similar to those of selection landscape 312 will be numbered with the prefix 400. The selection landscape 412 may be used with the selection screen 110 in the same manner as the selection landscape 312.

The selection landscape 412 may be divided into multiple selection zones by multiple boundary lines 422, 424, 430 and 432 extending from a center 434 of the selection landscape 412 to multiple intersections 436, 438, 440 and 442, respectively, with a selection landscape border 425. As illustrated in FIG. 12, each of the boundary lines 422, 424, 430 and 432 may extend from the center 434 such that the selection landscape 412 is divided into four selection zones 414, 416, 418 and 420 corresponding to the four performance goals, "Eco", "Gentler", "Cleaner" and "Quicker."

Figure 13:
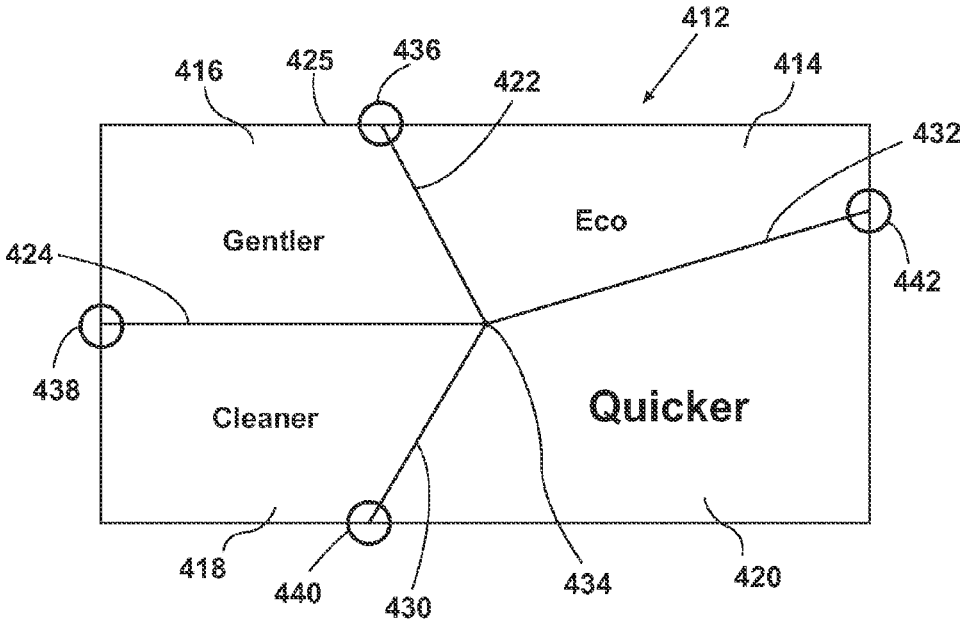
FIG. 13 is a front view of a user interface displaying a selection input/output screen according to the fifth embodiment of the invention.

The user may adjust the size of the selection zones 414, 416, 418 and 420 by moving the corresponding intersections 436, 438, 440 and 442 along the selection landscape border 325, as illustrated in FIG. 13, which causes the boundary lines 422, 424, 430 and 432 to rotate about the center 434. The user may move one or more of the intersections 436, 438, 440 and 442 to change the area of one or more selection zones 414, 416, 418 and 420 to select a desired performance goal weighting in the same manner as discussed above with respect to the selection landscape 312.

Figure 14:
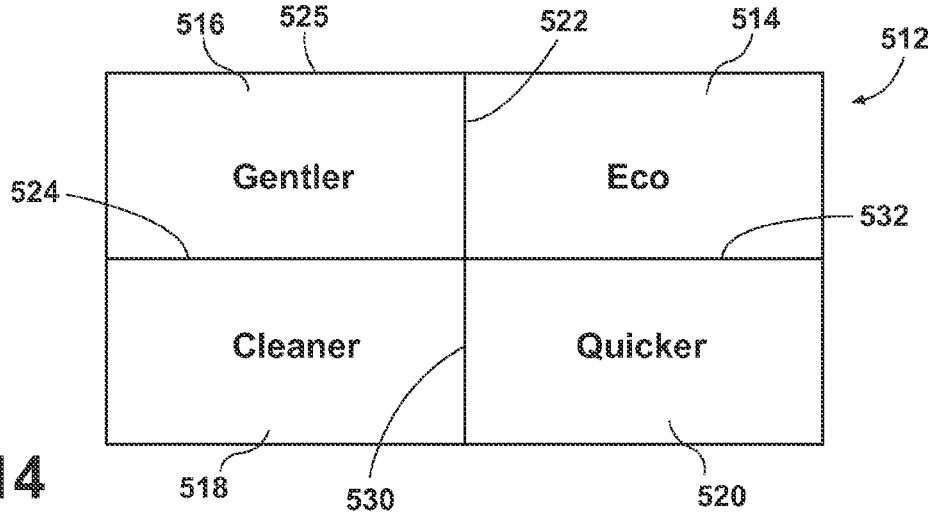
FIG. 14 is a front view of a user interface displaying a selection input/output screen according to a sixth embodiment of the invention.

Referring now to FIG. 14, a selection landscape 512 is illustrated which is similar to the selection landscape 112 except in the manner in which a pair of vertical boundary lines 522 and 530 and a pair of horizontal boundary lines 524 and 532 are moveable relative to the selection landscape 512. Therefore, elements in the selection landscape 512 similar to those of selection landscape 112 will be numbered with the prefix 500. The selection landscape 512 may be used with the selection screen 110 in the same manner as the selection landscape 112.

The selection landscape 512 may be divided into multiple selection zones by vertical boundary lines 522 and 530 and horizontal boundary lines 524 and 532 extending vertically and horizontally from a selection landscape border 525 across the selection landscape 512. Each boundary line 522, 524, 530 and 532 may be slidingly movable relative to the other boundary lines 522, 524, 530 and 532 to modify the area of one or more selection zones 514, 516, 518 and 520.

Figure 15:
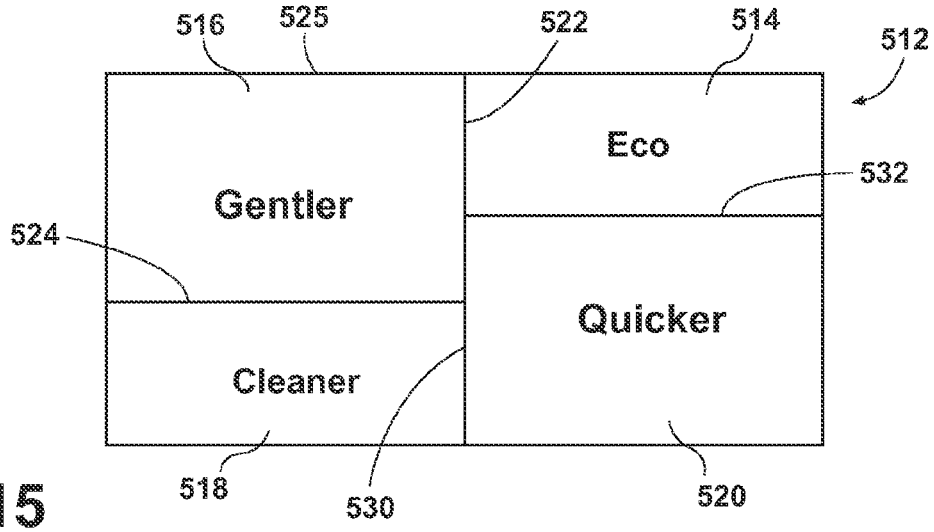
FIG. 15 is a front view of a user interface displaying a selection input/output screen according to the sixth embodiment of the invention.

For example, as illustrated in FIG. 15, boundary lines 524 and 532 may be moved along a vertical axis defined by the vertical boundary lines 522 and 530 to modify the selection zones 514, 516, 518 and 520 such that more weight is given to the performance goals of "Gentler" and "Quicker" than "Eco" and "Cleaner." As illustrated in FIG. 15, the vertical boundary lines 522 and 530 may be moved along a horizontal axis defined by the horizontal boundary lines 524 and 532 to modify the area of one or more selection zones 514, 516, 518 and 520. In this manner, the user may move one or more of the vertical boundary lines 522 and 530 and/or horizontal boundary lines 524 and 532 to change the area of one or more selection zones 514, 516, 518 and 520 to select a desired performance goal weighting in the same manner as discussed above with respect to the selection landscape 112.

Figure 16:
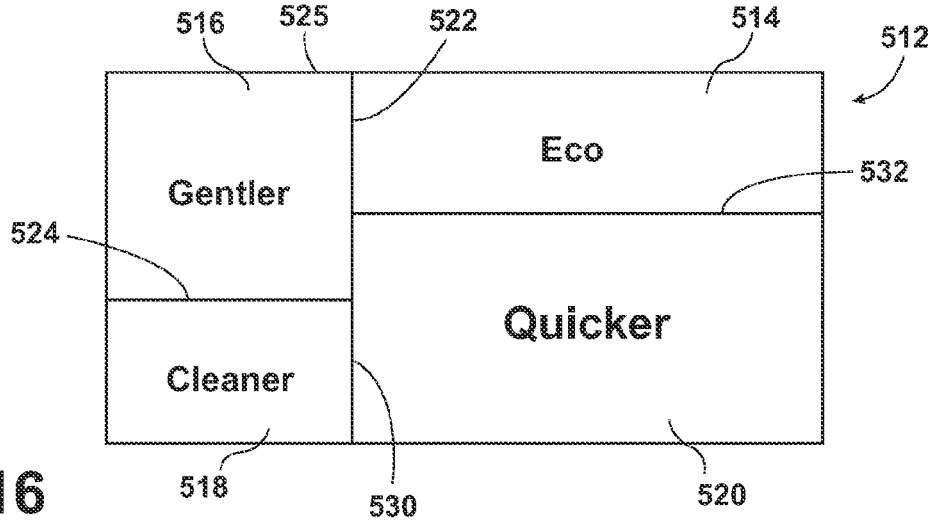
FIG. 16 is a front view of a user interface displaying a selection input/output screen according to the sixth embodiment of the invention.

The vertical boundary lines 522 and 530 may be moved as a single unit, as illustrated or independently of each other, in a manner similar to that illustrated by the horizontal boundary lines 524 and 532 in FIGS. 15 and 16. In a similar manner, the horizontal boundary lines 524 and 532 may be moved independently of each other, as illustrated, or as a single unit, in a manner similar to that illustrated by the vertical boundary lines 522 and 530.

The control software of the controller 14 may include a weighting module that is operably coupled with the input received from the touch screen 100 to set the operating parameters of the user-selected cycle of operation as a function of the user-selected weighting of the performance goals selected by the user through the performance goal selection screen 110. The weighting of the performance goals may be determined as a function of the area of each selection zone 114, 116, 118 and 120. While the weighting of the performance goals is described in the context of the selection landscape 112, it will be understood that the performance goals may be weighted in a similar manner using any of the selection landscapes 212, 312 and 412.

Figure 6:
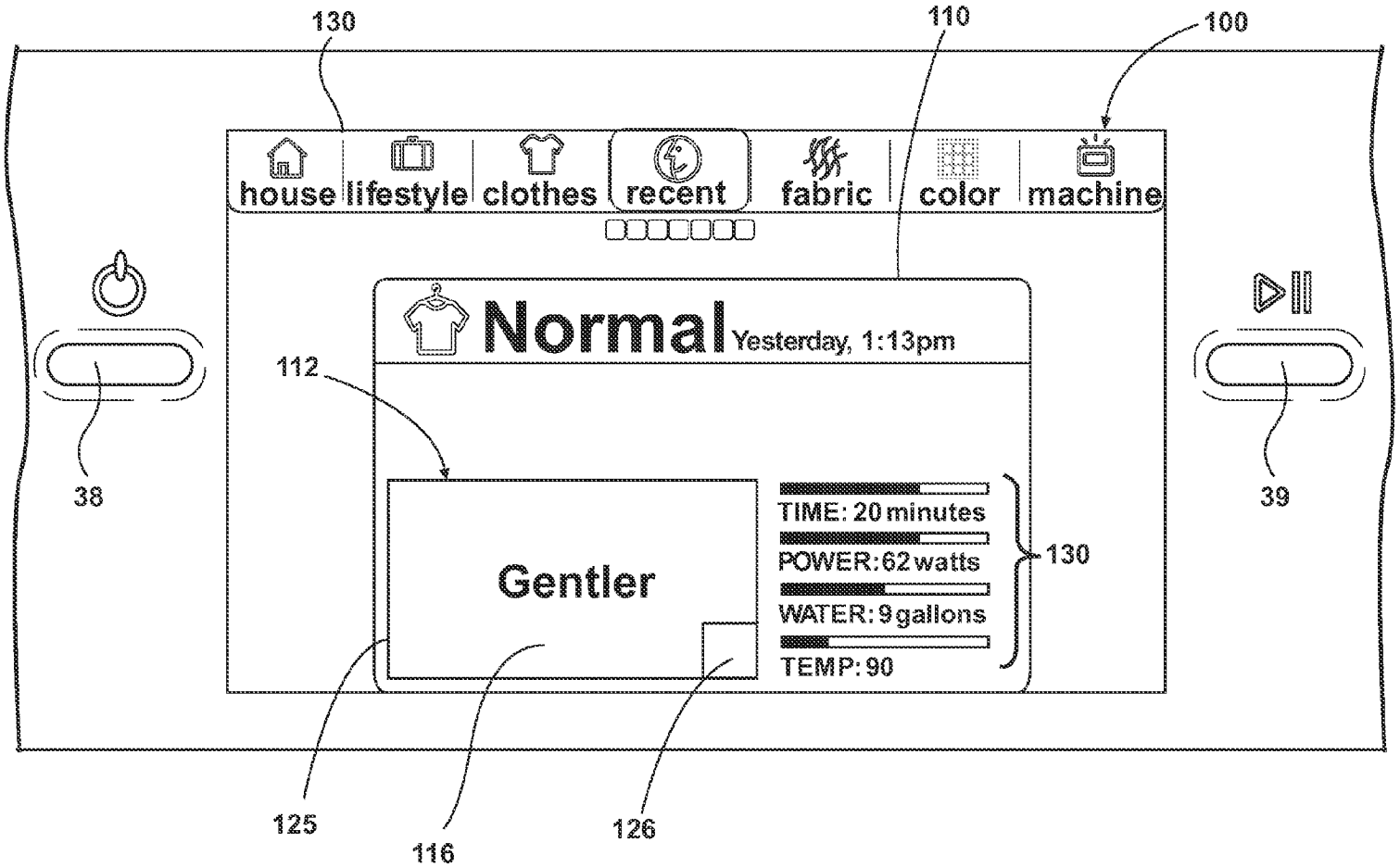
FIG. 6 is the front view of a user interface displaying a performance goal selection screen according to the second embodiment of the invention.

For example, the user may select a single performance goal, such as illustrated in FIG. 6, by adjusting the area of the four selection zones 114, 116, 118 and 120 such that the area of selection zone 116 fills the entire area of the selection landscape 112 and selection zones 114, 118 and 120 have no area. In this example, the weighting module may determine a 100% weighting of the performance goal corresponding to selection zone 116 and a 0% weighting of the other performance goals. The weighting module may then set one or more operating parameters based on the 100% weighting of "Gentler" and the 0% weighting of the other performance goals "Quicker", "Cleaner" and "Eco."

When the user selects multiple performance goals, such as illustrated in FIGS. 5 and 7, the weighting module may determine the settings for one or more operating parameters as a function of the weight given to each performance goal based on the area of each selection zone 114, 116, 118 and 120. For example, as illustrated in FIG. 5, the area of each selection zone 114, 116, 118 and 120 may be adjusted such that each selection zone has a different area, corresponding to a different weighted for each performance goal. The weighting module may determine the settings for at least one operating parameter based on the relative area of selection zone 114, 116, 118 and 120. For the example illustrated in FIG. 5, the area of selection zone 116 is approximately 52% of the total area of the selection landscape 112. The remaining selection zones 114, 118 and 120 have an area of approximately 16%, 25% and 8%, respectively, of the total area of the selection landscape 112. The weighting module may determine the settings for at least one operating parameter based on the relative area of each selection, giving the most weight to the performance goal "Gentler", corresponding to selection zone 116 and the least weight to the performance goal "Quicker", corresponding to selection zone 120. As the amount of area of a selection zone 114, 116, 118 and 120 relative to the total area of the selection landscape 112 increases, the weighting given to that selection zone increases.

The determination of the area of each selection zone 114, 116, 118 and 120 may be an absolute determination of an area or a relative determination of an area. For example, an absolute determination of an area may be based on the number of pixels forming the area. Alternatively, the area may be determined as a function of the area of the selection zone 114, 116, 118 and 120 relative to the area of the selection landscape 112 or relative to the area of one or more other selection zones 114, 116, 118 and 120.

The weighting given to each selection zone 114, 116, 118 and 120 may be part of a discrete or continuous scale. For example, the weighting given to a selection zone 114, 116, 118 and 120 may be limited to predetermined increments, such as 0%, 25%, 50%, 75% and 100%. When the user selects a weighting through the location of the boundary adjuster 126, the boundary adjuster 126 and the vertical and horizontal boundary lines 122, 124 may be controlled to "snap-to" a location such that the area of each selection zone 114, 116, 118 and 120 is representative of the predetermined weighting increment that is closest to that selected by the user. Alternatively, the movement of the boundary adjuster 126 and the weighting given to each selection zone 114, 116, 118 and 120 may be based on a continuous scale from 0 to 100.

The weighting module may determine the setting for one or more operating parameters as a function of the determined weighting for each performance goal by consulting a look-up table of weightings and corresponding values that may be stored in the memory 70 of the controller 14. The operating parameter may be set to a value in the table corresponding to a weighting in the table that most closely matches the determined weighting based on the user's selection. Alternatively, the look-up table may include a range of weightings and corresponding vales and the operating parameter may be set to a value in the table corresponding to the range of weightings in the table that coincides with the determined weighting.

The modification of one or more operating parameters may or may not be directly proportional to the relative weighting of a performance goal. The relative weighting may be used to determine a value using a look-up table, for example, in which the values are not directly proportional to the relative weighting. In another example, the weighting module may set a value for one or more operating parameters to a value that is directly proportional to the determined weighting of the performance goals. For example, the number of rinses for a given cycle may be directly proportional to the weighting a user gives to the performance goal "Cleaner"; as the weighting increases, the number of rinses may increase.

While the weightings of the performance goals are described in the context of percentages, the weighting module may determine the relative area of each selection zone 114, 116, 118 and 120 in any suitable manner. For example, the relative area of each selection zone 114, 116, 118 and 120 may be determined as a function of a number of pixels corresponding to each selection zone 114, 116, 118 and 120 as defined by the vertical and horizontal boundary lines 122, 124 and the selection landscape border 125.

In addition, if the user selects a performance goal weighting that may create an environment that damages the laundry and/or machine, the control software may be programmed to alert the user of the potential damage and/or modify one or more operating parameters to avoid damaging the laundry and/or machine.

While the invention has been described in the context of first selecting a cycle of operation and then setting the performance goal weighting for the selected cycle, it is also within the scope of the invention for a user to first select a desired performance goal weighting and then select a cycle of operation. In the latter case, the operating parameters for the user-selectable cycles of operation will automatically be modified to achieve the selected performance goal and the information displayed to the user through the output displays 130 may automatically be adjusted accordingly.

The invention described herein provides the user with an opportunity to modify a cycle of operation to achieve a desired performance goal. The laundry treating appliance may automatically adjust one or more operating parameters of a cycle of operation to achieve the desired performance goal. Modifying a cycle of operation according to a user-selected performance goal may make the operating cycle more efficient by controlling the operation of the laundry treating appliance according to the user's specific needs and may also lead to increased user satisfaction.

The invention is not limited to performance goals and may be used to weight any system input. The weighting of the system input may then be used to set one or more operating parameters for a cycle of operation based on the weighting of the system input. In one example, a selection landscape may be sub-divided into selection zones corresponding to different colors or different fabric types. The user may adjust the relative area of each of the selection zones to represent the relative of amount of each color or fabric type forming the laundry load. In another example, a selection landscape may be subdivided into two selection zones, with the area of one of the selection zones corresponding to the amount of laundry in the load. One or more operating parameters may then be set according to the amount of laundry in the load as indicated by the user through the adjustment of the area of the corresponding selection zone.

Providing the user with an interactive graphic through which the user may weight one or more system inputs may make the selection process more intuitive and informative for the user, further increasing user satisfaction and appliance efficiency. The system described herein provides the user with the opportunity to input data relating to the laundry and/or to the user's preference and provides visual feedback to the user during the input process.

While the invention has been specifically described in connection with certain specific embodiments thereof, it is to be understood that this is by way of illustration and not of limitation, and the scope of the appended claims should be construed as broadly as the prior art will permit.

What is claimed is:

1. A control system for a laundry treating appliance having a plurality of components that are operated to implement a treatment cycle having multiple operating parameters on a load of laundry received within a treating chamber of the appliance, the control system comprising:

a controller operably coupled with at least one of the plurality of components to control the operation of the at least one of the plurality of components to implement a treatment cycle and configured to provide:

a selection landscape subdivided into multiple selection zones, each selection zone representing a system input for the control system and having a boundary defining an area for each selection zone; and a boundary adjuster operably coupled to the selection landscape to alter at least one boundary and thereby alter a corresponding area of at least one of the multiple selection zones; and wherein the controller is configured to determine a system input weighting based on the area of at least one of the multiple selection zones relative to a total area of all of the selection zones, and determine at least one of the multiple operating parameters as a function of the determined system input weighting; and wherein a user may control the operation of the treatment cycle by moving the boundary adjuster relative to the selection landscape to change the system input weighting.

2. The control system of claim 1 wherein the selection landscape comprises a plurality of boundaries and further comprises a grid forming the plurality of boundaries.

3. The control system of claim 2 wherein the grid comprises multiple intersecting lines which define at least one intersection point.

4. The control system of claim 3 wherein the boundary adjuster moves at least one line to alter at least one boundary of the plurality of boundaries.

5. The control system of claim 4 wherein moving the at least one line results in a corresponding movement of at least one of the multiple intersecting lines.

6. The control system of claim 3 wherein the boundary adjuster moves at least one of the at least one intersection points to alter at least one boundary.

7. The control system of claim 6 wherein moving one of the at least one intersection points results in a corresponding movement of at least one of the multiple intersecting lines.

8. The control system of claim 3 wherein the grid comprises at least two sets of parallel lines with the parallel lines of one set being substantially orthogonal to the parallel lines of the at least one other set.

9. The control system of claim 8 wherein the at least two sets of parallel lines form at least one polygon, the at least one polygon forming a boundary defining an area of at least one of the multiple selection zones.

10. The control system of claim 9 wherein at least one line of the at least two sets of parallel lines can be moved to alter the area of the polygon.

11. The control system of claim 9 wherein the polygon comprises at least one corner formed by an intersection of two lines of the at least two sets of parallel lines.

12. The control system of claim 11 wherein the area of the polygon can be altered by moving the intersection, thereby altering the area of at least one of the multiple selection zones.

13. The control system of claim 3 wherein the grid comprises a single intersection point forming an origin and the multiple intersecting lines intersect at the origin to form a pie-shaped grid.

14. The control system of claim 13 wherein rotation of one of the multiple intersecting lines about the origin alters an area of at least one of the multiple selection zones defined by the multiple intersecting lines.

15. The control system of 13 wherein movement of the origin alters an area of at least one of the multiple selection zones defined by the multiple intersecting lines.

16. The control system of claim 1 wherein the system input represented by each selection zone comprises at least one of a qualitative or a quantitative parameter.

17. The control system of claim 16 wherein the at least one qualitative parameter comprises a performance goal for the treatment cycle and the at least one quantitative parameter comprises at least one of an operating parameter of the treatment cycle or a characteristic of the laundry.

18. The control system of claim 17 wherein the characteristic of the laundry comprises at least one of an amount of laundry or a type of fabric.

19. The control system of claim 1 wherein each selection zone comprises indicia indicating a corresponding system input.

20. The control system of claim 1 further comprising a user interface operably coupled with the controller for communicating a set value for the at least one of the multiple operating parameters with a user as the user moves the boundary adjuster relative to the selection landscape.

21. The control system of claim 20 wherein the user interface comprises a touchscreen.

* * * * *